US005361588A

United States Patent [19]

Asami et al.

[11] Patent Number: 5,361,588

[45] Date of Patent: Nov. 8, 1994

[54] CRYOGENIC REFRIGERATOR

[75] Inventors: Hiroshi Asami, Yokohama; Mitsuru Suzuki, Hiratsuka, both of Japan

[73] Assignee: Sumitomo Heavy Industries, Ltd., Tokyo, Japan

[21] Appl. No.: 87,710

[22] PCT Filed: Nov. 17, 1992

[86] PCT No.: PCT/JP92/01500

§ 371 Date: Jul. 14, 1993

§ 102(e) Date: Jul. 14, 1993

[87] PCT Pub. No.: WO93/10407

PCT Pub. Date: May 27, 1993

[30] Foreign Application Priority Data

Nov. 18, 1991 [JP] Japan ..... 3-328401

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,205,668 | 9/1965 | Gifford | 62/6 |
| 3,312,239 | 4/1967 | Chellis | 62/6 |
| 3,460,344 | 8/1969 | Johnson | 62/6 |
| 3,625,015 | 12/1971 | Chellis | 62/6 |
| 4,180,984 | 1/1980 | Chellis | 62/6 |
| 4,388,809 | 6/1983 | Sarcia | 62/6 |
| 4,389,850 | 6/1983 | Sarcia | 62/6 |
| 4,391,103 | 7/1983 | Sarcia | 62/6 |
| 4,520,630 | 6/1985 | Sarcia | 62/6 |
| 4,622,823 | 11/1986 | Ishizawa et al. | 62/6 |

FOREIGN PATENT DOCUMENTS 58-190663 11/1983 Japan .

58-190664 11/1984 Japan .

*Primary Examiner*—Ronald C. Capossela

*Attorney, Agent, or Firm*—Nikaido, Marmelstein, Murray & Oram

[57] ABSTRACT

In a cryogenic refrigerator using a Gifford MacMahon (GM) cycle, a rotary valve device (RV) for controlling the supply and discharge of refrigerant gas with respect to the refrigerator (2) is adapted by a reversible motor (15) to be rotated in normal and reverse directions, and during the rotation in the normal direction, a cooling mode operation for producing cold by an adiabatic expansion is effected, and during the rotation in the reverse direction, a temperature-raising mode operation for producing heat by an adiabatic compression is effected. In order that the optimum efficiency can be obtained in each of the cooling mode operation and the temperature-raising mode operation, the timing of opening and closing of the rotary valve device (RV) with respect to the reciprocal movement of displacers (*3a*, *3b*) during the rotation in the normal direction is made different from said timing during the rotation in the reverse direction. As a result, the time required for raising the temperature of a cooling portion in a cryogenic condition to the normal temperature can be shortened without the need for any special equipment.

2 Claims, 3 Drawing Sheets

CRYOGENIC REFRIGERATOR

TECHNICAL FIELD

This invention relates to a cryogenic refrigerator using a Gifford MacMahon (GM) cycle or the like, and more particularly to a cryogenic refrigerator having the function of raising the temperature of a cooling portion in a cryogenic condition to the normal temperature.

For example, in a cryopump using a cryogenic refrigerator utilizing a Gifford MacMahon cycle, for raising the temperature of a cooling portion to the normal temperature, there have heretofore been used a method of introducing dry nitrogen gas into a vacuum vessel and a method of flowing electric current through a heater, provided at the cooling portion, to produce Joule heat by which the temperature is raised; however, either of these methods requires some special equipment, and besides has a problem that a panel temperature does not rise quickly.

Therefore, there has been proposed in U.S. Pat. No. 4,520,630, a method in which a drive motor for a refrigerator is reversely rotated to operate a refrigeration cycle reversely, thereby raising the temperature. This method has a problem that during a temperature-raising mode operation, the phase of a displacer becomes inconsistent with a valve opening-closing timing, so that a sufficient temperature-raising effect can not be obtained.

DISCLOSURE OF THE INVENTION

It is an object of this invention to provide a cryogenic refrigerator using a Gifford MacMahon (GM) cycle, in which the time required for raising the temperature of a cooling portion to the normal temperature can be shortened using a method of reversely operating a refrigeration cycle, without the use of any special equipment for raising the temperature of the cooling portion.

In order to achieve the above object, according to the present invention, there is provided a cryogenic refrigerator of the Gifford MacMahon cycle-type comprising at least one cylinder; at least one displacer which has a regenerator therein and is reciprocally movable within the cylinder; upper and lower empty chambers provided within the cylinder and disposed exteriorly of opposite ends of the displacer, the both empty chambers being communicated with each other via the regenerator within the displacer; a rotary valve device for controlling the flow of refrigerant gas under high pressure into the empty chambers and for controlling the flow of the refrigerant gas under low pressure from the empty chambers; and a reversible motor for rotating the rotary valve device in normal and reverse directions and for controlling the reciprocal movement of the displacer, wherein when the rotary valve device is rotated in the normal direction, the refrigerant gas in the lower empty chamber is subjected to an adiabatic expansion to produce cold, and when the rotary valve device is rotated in the reverse direction, the refrigerant gas in the lower empty chamber is subjected to an adiabatic compression to produce heat; the cryogenic refrigerator being characterized by the provision of means by which the timing of opening and closing of the rotary valve device with respect to the reciprocal movement of the displacer during the rotation in the normal direction is made different from the timing during the rotation in the reverse direction.

In a preferred embodiment of the present invention, the rotary valve device comprises a fixed valve body, and a valve plate rotatably supported in face-to-face contact with the valve body, and the means by which the timing of opening and closing of the rotary valve device with respect to the reciprocal movement of the displacer during the rotation in the normal direction is made different from the timing during the rotation in the reverse direction comprises an engagement groove formed in a rear surface of the valve plate and extending circumferentially over a predetermined angle, and a pin portion provided on a crank driven by the reversible motor and engaged in the engagement groove in the valve plate. Therefore, there is provided a feature that during the rotation of the crank in a normal or a reverse direction, the valve plate does not rotate but idles until the pin portion is brought into engagement with one or the other end of the engagement groove.

BEST MODE FOR CARRYING OUT THE INVENTION

Figure 1:
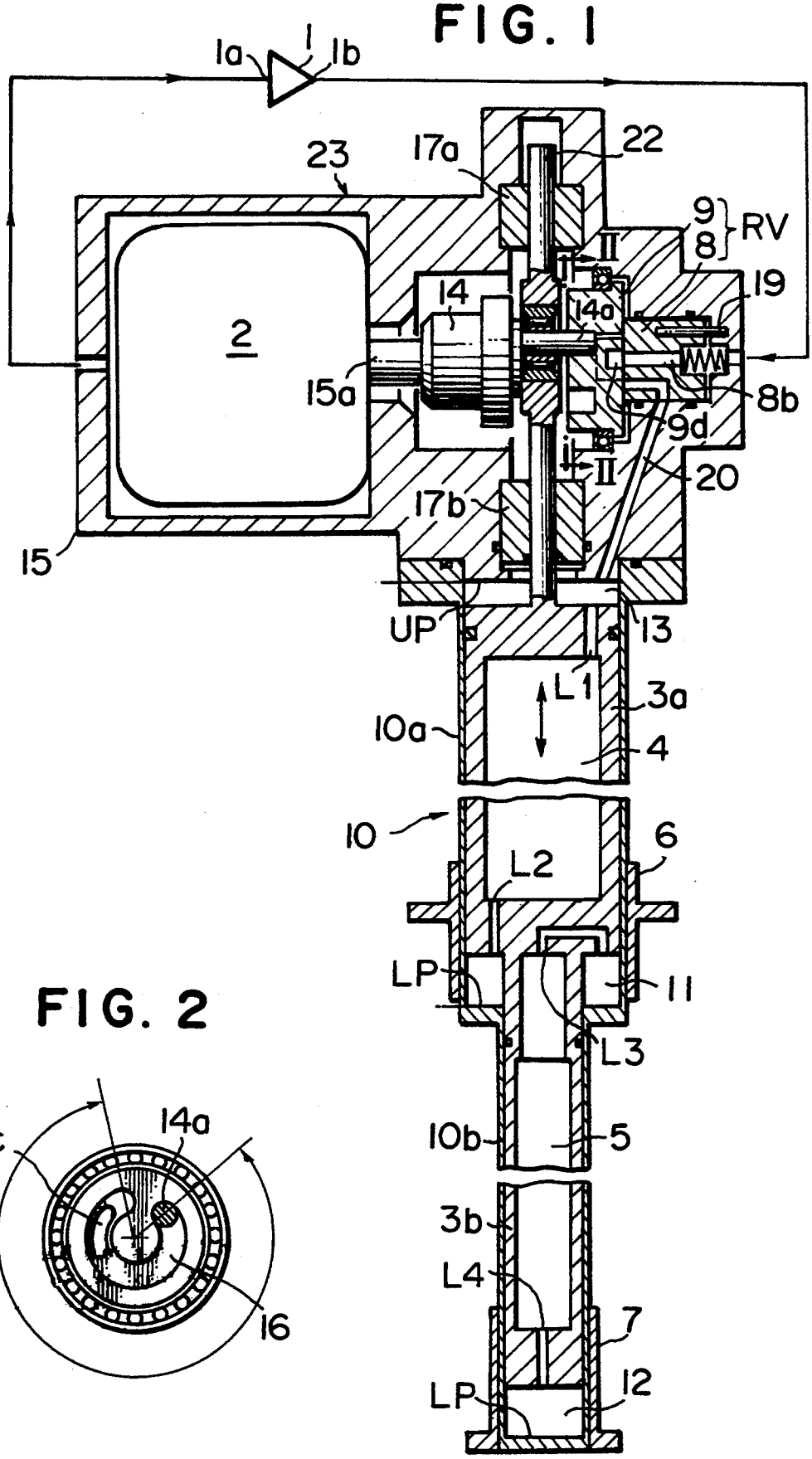
FIG. 1 is a cross-sectional view of a refrigerator of the Gifford MacMahon cycle-type according to the present invention.

In FIG. 1, a compressor 1 draws refrigerant gas from a low-pressure side 1*a*, increases a pressure thereof, cools it, and then discharges it to a high-pressure side 1*b*.

A refrigerator 2 is divided into a housing portion 23 and a cylinder portion 10. Displacers 3*a*, 3*b*, which are integral with each other and contain regenerators 4, 5, respectively, are slidably received respectively in upper and lower cylinders 10*a*, 10*b* arranged in a two-stage manner. Empty chambers 11 (first-stage lower empty chamber), 12 (second-stage lower empty chamber) and 13 (upper empty chamber) are formed between the displacers 3*a*, 3*b* and the cylinders 10*a*, 10*b*. The empty chambers 11, 12, 13 are communicated with one another through the displacers 3*a*, 3*b*, containing the respective regenerators 4, 5, and refrigerant gas passages L1~L4. Flanges 6, 7 are held in intimate contact respectively with the outer peripheries of the lower portions of the cylinders 10*a*, 10*b* in heat-transferring relation thereto.

The displacers 3*a*, 3*b* are connected to a Scotch yoke 22 supported by sliding bearings 17*a*, 17*b*, and are driven through a reversible motor 15, a crank 14 and the Scotch yoke 22 to reciprocally move within the cylinders 10*a*, 10*b*, respectively. When the volumes of the empty chambers 11, 12 within the cylinders 10*a*, 10*b* increase in accordance with the reciprocal movement of the displacers 3*a*, 3*b*, the volume of the empty chamber 13 decreases, and when the volumes of the empty chambers 11, 12 decrease, the volume of the empty chamber 13 is so changed as to increase, and refrigerant gas moves between the empty chambers 11, 12, 13 through the refrigerant gas passages L1~L4.

A rotary valve device RV for controlling the flow of the refrigerant gas is provided between the compressor 1 and the cylinders 10*a*, 10*b*, and is so constructed as to guide the refrigerant gas, fed from the high-pressure side 1*b* of the compressor 1, into the cylinders 10*a*, 10*b*, and also to guide the refrigerant gas, fed from the cylinders 10*a*, 10*b*, to the low-pressure side 1*a* of the compressor 1.

Figure 2:
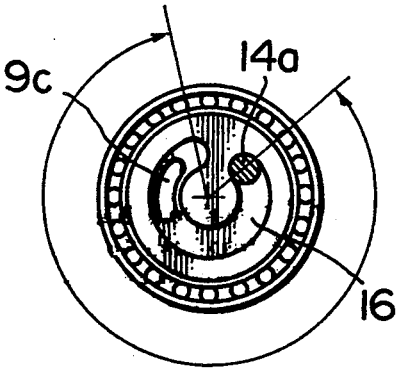
FIG. 2 is an end view of a valve plate of a rotary valve device used in the above refrigerator, taken along the line II—II of FIG. 1.
Figure 3:
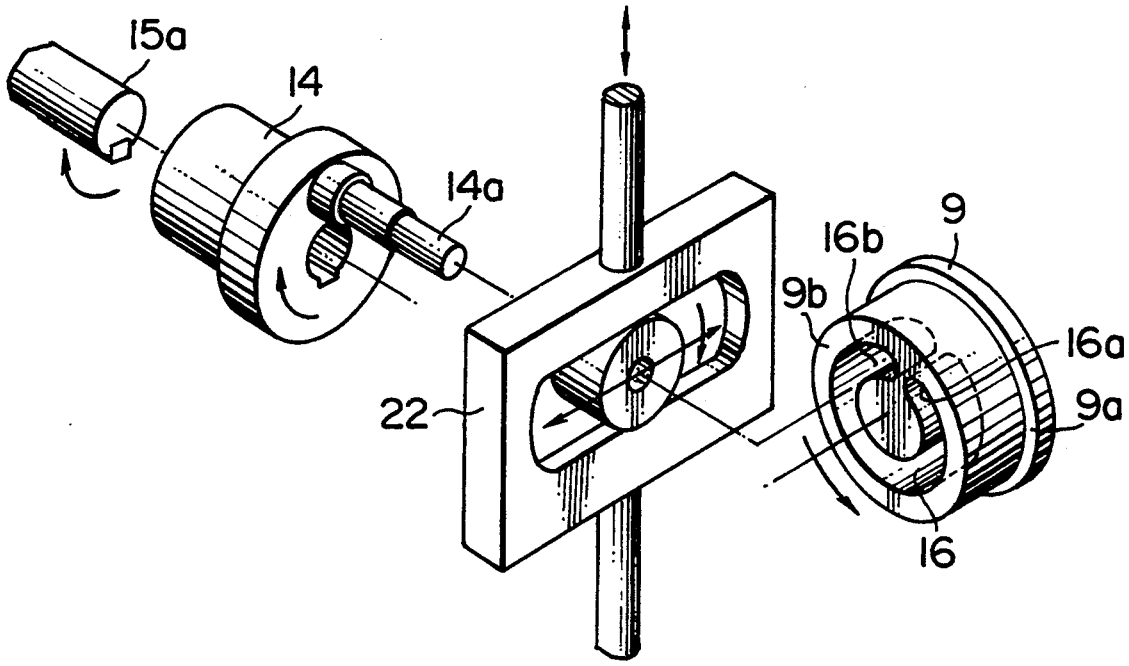
FIG. 3 is an exploded, perspective view showing a drive mechanism for the valve plate and a Scotch yoke.

The rotary valve device RV comprises a valve body 8, and a valve plate 9, and the valve body 8 is fixedly mounted within the housing by a fixing pin 19. As shown in FIGS. 2 and 3, the valve plate 9 has an engagement groove 16 which is formed in a circumferential direction (in the embodiment, the angle in the circumferential direction is 280°) and is engaged with a pin portion 14*a* of the crank 14 which drives the Scotch yoke 22. When the pin portion 14*a* is engaged with an end 16*a* or an end 16*b* of the engagement groove 16 upon rotation of the crank 14 in its normal or its reverse direction, the motion of the crank 14, that is, the rotation of a reversible motor shaft 15*a*, is transmitted to the valve plate 9 to rotate the valve plate 9. The engagement groove 16 in the circumferential direction and the pin portion 14*a* connect the valve plate 9 and the reversible motor shaft 15*a* together in such a manner that idling occurs between the normal rotation and the reverse rotation through an angle of 280° in this embodiment.

Figure 4:
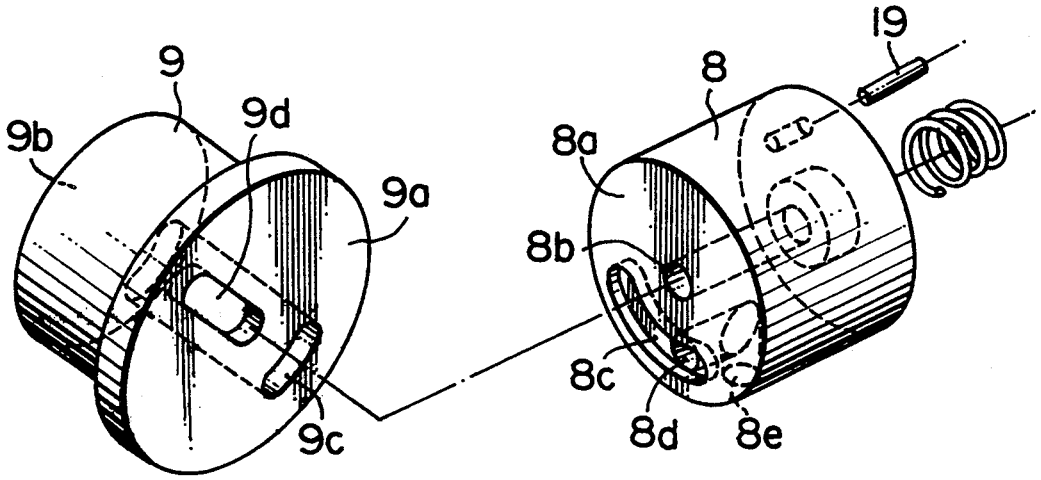
FIG. 4 is an exploded, perspective view showing the valve plate and a valve body constituting the rotary valve device.

A refrigerant gas intake hole 8*b* is formed through the central portion of the valve body 8, and is connected to the high-pressure side 1*b* of the compressor 1. As shown in FIG. 4, an arcuate groove 8*c* is formed in an end face 8*a* facing the valve plate, and is disposed in concentric relation to the intake hole 8*b*. There is formed a communication hole 8*d* which is open at one end thereof to the groove 8*c* and is extended through the body 8 to be communicated at the other end thereof with a discharge port 8*e* open to the side surface of this body. The discharge port 8*e* is open to the empty chamber 13 via a passage 20. A groove 9*d* is formed in an end face 9*a* of the valve plate 9 facing the valve body, and extends radially from its center. An arcuate hole 9*c* is formed through the valve plate 9 to extend from the end face 9*a* to the opposite end face 9*b*, and is disposed on the same circumference as that of the arcuate groove 8*c* in the valve body 8. An intake valve is constituted by the intake hole 8*b*, the groove 9*d*, the arcuate groove 8*c* and the communication hole 8*d*, and an exhaust valve is constituted by the communication hole 8*d*, the arcuate groove 8*c* and the arcuate hole 9*c*.

Figure 5:
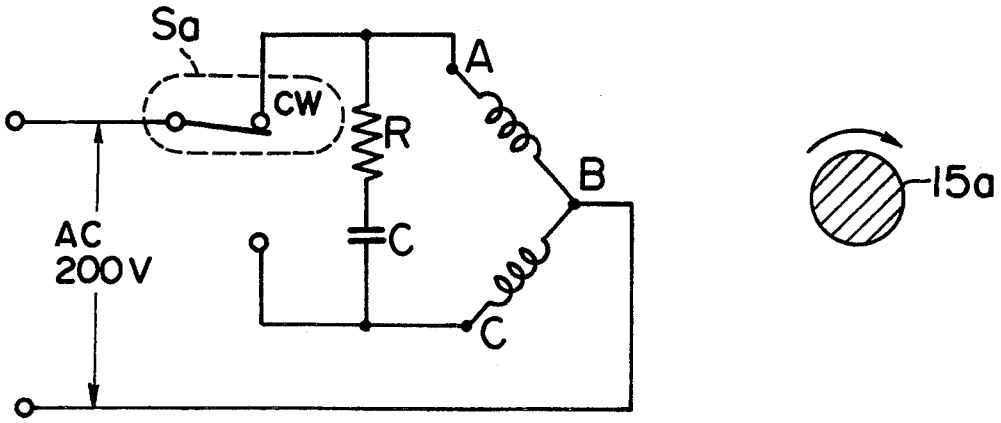
FIG. 5 is a diagram of a motor connection wiring of a conventional refrigerator of a Gifford MacMahon cycle-type.
Figure 6:
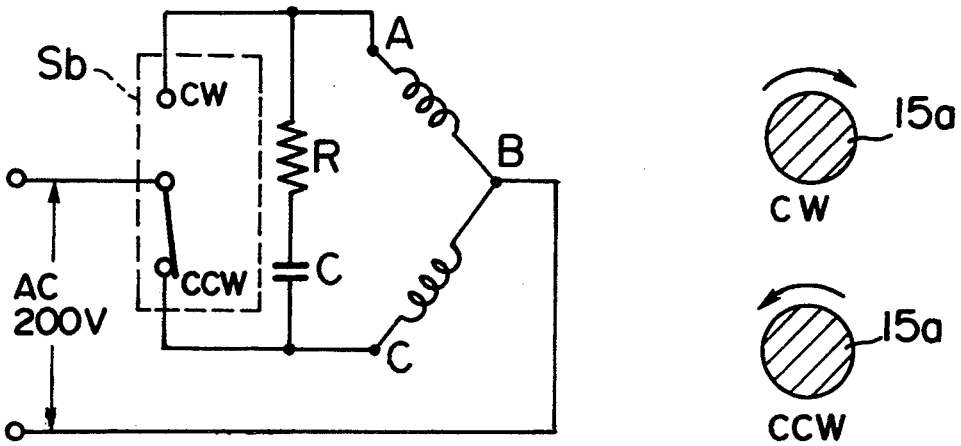
FIG. 6 is a diagram of a motor connection wiring of the refrigerator of a Gifford MacMahon cycle-type according to the present invention.

A wiring of connection of the above reversible motor, as well as the direction of rotation thereof, is shown in FIG. 5. Namely, in a conventional refrigerator, the motor shaft 15*a* is caused by a switch Sa to rotate only in a normal direction. On the other hand, by the provision of a changeover switch Sb, the direction of rotation of the motor shaft 15*a* in the present invention can be switched between a CW contact (rotation in a normal direction) in a cooling mode and a CCW contact (rotation in a reverse direction) in a temperature-raising mode.

The operation in the cooling mode is effected by the rotation of the reversible motor 15 in the normal direction. At this time, the pin portion 14*a* of the crank 14 is engaged with one end 16*a* of the engagement groove 16 in the valve plate 9 to rotate the valve plate 9 in the normal direction.

Before the displacers 3*a*, 3*b* reach a bottom dead center LP (in the embodiment, when they reach a position an angle of 20° before the bottom dead center), the exhaust valve is closed, and also a passage is formed between the communication hole 8*d*, the arcuate groove 8*c* and the groove 9*d* (the intake valve is opened), and the refrigerant gas under a high pressure begins to fill in the empty chamber 13 via the passage 20 in the housing. Namely, the intake valve is already in an open condition before the displacers 3*a*, 3*b* reach the bottom dead center. The displacers 3*a*, 3*b* pass past the bottom dead center, and begin to move upward, and the refrigerant gas passes downward through the regenerators 4, 5 to fill in the empty chambers 11, 12.

Before the displacers 3*a*, 3*b* reach a top dead center UP (in the embodiment, when they reach a position an angle of 65° before the top dead center), the intake valve is closed. Before the displacers 3*a*, 3*b* reach the top dead center (in the embodiment, when they reach a position an angle of 45° before the top dead center), a passage is formed between the communication hole 8*d*, the arcuate groove 8*c* and the arcuate hole 9*c* (the exhaust valve is opened). The refrigerant gas under high pressure undergoes an adiabatic expansion to produce cold to cool the flanges 6, 7, and moves upward while cooling the regenerators 4, 5, and begins to be returned to the low-pressure side 1*a* of the compressor 1.

Before the displacers 3*a*, 3*b* reach the bottom dead center LP (in the embodiment, when they reach a position an angle of 20° before the bottom dead center), the exhaust valve is closed, and the intake valve is opened, thus finishing one cycle.

The operation in a temperature-raising mode is effected by the rotation of the reversible motor 15 in the reverse direction. In contrast with the cooling mode operation, the pin portion 14*a* of the crank 14 is engaged with the other end 16*b* of the engagement groove 16 in the valve plate 9 to rotate the valve plate 9 in the reverse direction.

When the displacers 3*a*, 3*b* reach a position before the top dead center UP (that is, a position 35° before the top dead center in the embodiment), the exhaust valve is closed, and further when they reach a position before the top dead center (that is, a position 15° before the top dead center in the embodiment), a passage is formed between the communication hole 8*d*, the arcuate groove 8*c* and the groove 9*d* (the intake valve is opened), and the refrigerant gas under high pressure pass through the regenerators 4, 5 via the passage 20 in the housing to fill in the empty chambers 11, 12, and the temperature of the flanges 6, 7 in a low-temperature condition is raised by a compression heat (adiabatic compression work at the time of filling of the gas) produced at this time.

Before the displacers 3*a*, 3*b* reach the bottom dead center (in the embodiment, when they reach a position an angle of 60° before the bottom dead center), the intake valve is closed, and at the same time a passage is formed between the communication hole 8*d*, the arcuate groove 8*c* and the arcuate hole 9*c* (the exhaust valve is opened), and the refrigerant gas in the empty chamber 13 undergoes an adiabatic expansion to produce cold. The refrigerant gas under low pressure which has decreased in temperature is discharged directly into the housing 23 and is returned to the low-temperature side 1*a* of the compressor 1*a*, without effecting a heat exchange with the regenerators 4, 5.

When the displacers 3 reach a position before the top dead center (that is, a position 35° before the top dead center in the embodiment), the exhaust valve is closed, thus finishing one cycle.

CAPABILITY OF EXPLOITATION IN INDUSTRY

In a conventional method in which at the time of regenerating a cryopump, the operation of a refrigerator is stopped, and then heat is supplied by heated gas, a heater or the like to a surface of a cryo-panel from the exterior, the temperature of a regenerator within a displacer can not be raised easily, and therefore much time is required for raising the panel temperature. In the present invention, however, the refrigerant gas is subjected to an adiabatic compression within the cylinder of the refrigerator to produce heat, and therefore the temperature of the regenerators in the displacers is first raised, and besides in the temperature-raising mode operation, the opening and closing of the intake valve and the exhaust valve of the refrigerator are automatically adjusted to an optimum timing for effecting the temperature-raising operation, and therefore the time required for raising the temperature of the cryo-panel can be greatly reduced.

We claim:

1. A cryogenic refrigerator of the Gifford MacMahon cycle-type comprising at least one cylinder; at least one displacer which has a regenerator therein, and is reciprocally movable within said cylinder; empty chambers provided within said cylinder, and disposed exteriorly of opposite ends of said displacer, said empty chambers being communicated with each other via said regenerator within said displacer; a rotary valve device for controlling the flow of refrigerant gas under high pressure into said empty chambers and for controlling the flow of refrigerant gas under low pressure from said empty chambers, said rotary valve device including a fixed valve body and a valve plate rotatably supported in face-to-face contact with said valve body; and a reversible motor for rotating said rotary valve device in normal and reverse directions and for controlling the reciprocal movement of said displacer, said reversible motor driving a crank, wherein when said rotary valve device is rotated in the normal direction, the refrigerant has in the lower empty chamber is subjected to an adiabatic expansion to produce cold, and when the rotary valve device is rotated in the reverse direction, the refrigerant gas in the lower empty chamber is subjected to an adiabatic compression to produce heat; and means by which the timing of opening and closing of said rotary valve device with respect to the reciprocal movement of said displacer during rotation in the normal direction is made different from said timing during rotation in the reverse direction, said means comprising an engagement groove formed in a rear surface of said valve plate and extending circumferentially over a predetermined angle, and a pin portion provided on said crank driven by said reversible motor and engaged in said engagement groove in said valve plate, whereby during rotation of said crank in a normal or reverse direction, said valve plate does not rotate but idles until said pin portion is brought into engagement with one or the other end of said engagement groove.

2. A cryogenic refrigerator according to claim 1, in which said engagement groove is formed in such a manner that said idling is effected through about 280°.

* * * * *